US006074706A

United States Patent [19]

Beverley et al.

[11] Patent Number: 6,074,706

[45] Date of Patent: Jun. 13, 2000

[54] ADHESION OF A CERAMIC LAYER DEPOSITED ON AN ARTICLE BY CASTING FEATURES IN THE ARTICLE SURFACE

[75] Inventors: Michael Beverley, West Chester; John P. Heyward, Loveland; Jeffrey A. Conner, Hamilton, all of Ohio

[73] Assignee: General Electric Company, Cincinnatti, Ohio

[21] Appl. No.: 09/210,829

[22] Filed: Dec. 15, 1998

[51] Int. Cl.[7] ..... C23C 4/02; C23C 4/10

[52] U.S. Cl. ..... 427/454; 427/453; 427/248.1; 427/250; 427/383.7; 29/527.3; 29/889.7; 29/889.71; 29/889.72; 29/889.721; 29/889.2

[58] Field of Search ..... 427/453, 454, 427/456, 250, 248.1, 383.7; 29/527.3, 889.7, 889.71, 889.72, 889.721, 889.2

[56] References Cited

U.S. PATENT DOCUMENTS 4,914,794 4/1990 Strangman ..... 29/889.2

5,419,971 5/1995 Skelly et al. ..... 428/612

FOREIGN PATENT DOCUMENTS 1012688 12/1965 United Kingdom .

OTHER PUBLICATIONS

Thermal Spray, Practice, Theory, and Application, American Welding Society, Inc., p. 22, 1985, (no month date).

*Primary Examiner*—Katherine A. Bareford
*Attorney, Agent, or Firm*—Andrew C. Hess; David L. Narciso

[57] ABSTRACT

A method of forming a thermal barrier coating system on an article subjected to a hostile thermal environment, such as the hot gas path components of a gas turbine engine. The coating system is generally composed of a ceramic layer and preferably a bond coat that adheres the ceramic layer to the component surface. Surface features such as grooves are cast directly into the surface of the component. If the bond coat is present, the grooves in the component surface cause the bond coat to also have grooves that generally correspond to the grooves in the component surface.

20 Claims, 1 Drawing Sheet

ADHESION OF A CERAMIC LAYER DEPOSITED ON AN ARTICLE BY CASTING FEATURES IN THE ARTICLE SURFACE

FIELD OF THE INVENTION

This invention relates to thermal barrier coatings for components exposed to high temperatures, such as the hostile thermal environment of a gas turbine engine. More particularly, this invention is directed to a method of forming features in a surface on which a thermal barrier coating is deposited, such that the coating is more resistant to spalling.

BACKGROUND OF THE INVENTION

Higher operating temperatures of gas turbine engines are continuously sought in order to increase their efficiency. However, as operating temperatures increase, the high temperature durability of the components of the engine must correspondingly increase. Significant advances in high temperature capabilities have been achieved through the formulation of nickel and cobalt-base superalloys, and through the single-crystal (SX) and directional solidification (DS) methods that have been developed for these alloys. However, thermal and environmental protection is required for superalloy components if they are to operate in the hot sections of a gas turbine engine, such as the turbine, combustor and augmentor. A common solution is to thermally insulate such components in order to minimize their service temperatures. For this purpose, thermal barrier coatings (TBCs) formed on the exposed surfaces of high temperature components have found wide use.

To be effective, TBCs must have low thermal conductivity, be capable of strongly adhering to the article, and remain adherent through many heating and cooling cycles. The latter requirement is particularly demanding due to the different coefficients of thermal expansion between low thermal conductivity materials used to form TBCs, typically ceramic, and the superalloy materials used to form turbine engine components. For this reason, ceramic TBCs are typically deposited on a metallic bond coat that is formulated to promote the adhesion of the ceramic layer to the component while also inhibiting oxidation of the underlying superalloy. Together, the ceramic layer and metallic bond coat form what is termed a thermal barrier coating system. Typical bond coat materials are diffusion aluminides and oxidation-resistant alloys such as MCrAlY, where M is iron, cobalt and/or nickel. The aluminum content of these bond coat materials provides for the slow growth of a strong adherent continuous aluminum oxide layer (alumina scale) at elevated temperatures. This thermally grown oxide (TGO) protects the bond coat from oxidation and hot corrosion, and chemically bonds the ceramic layer to the bond coat.

Various ceramic materials have been employed as the TBC, particularly zirconia ($ZrO_2$) stabilized by yttria ($Y_2O_3$), magnesia (MgO) or other oxides. These particular materials are widely employed in the art because they can be readily deposited by plasma spraying and vapor deposition techniques. A continuing challenge of thermal barrier coating systems has been the formation of a more adherent ceramic layer that is less susceptible to spalling when subjected to thermal cycling. In one form, improved spallation resistance is achieved with ceramic coatings deposited by physical vapor deposition (PVD), particularly electron beam physical vapor deposition (EBPVD), to yield a columnar grain structure characterized by gaps between grains that are oriented perpendicular to the substrate surface. A columnar grain structure promotes strain tolerance by enabling the ceramic layer to expand with its underlying substrate without causing damaging stresses that lead to spallation.

Zirconia-based thermal barrier coatings, and particularly yttria-stabilized zirconia (YSZ) coatings, produced by EBPVD to have columnar grain structures are widely employed in the art for their desirable thermal and adhesion characteristics. Nonetheless, there is an ongoing effort to improve thermal barrier coatings, particularly in terms of improved spallation resistance. One approach is to produce bond coats with relatively rough surfaces that promote adhesion of ceramic TBCs by delaying the initiation of TBC cracking caused by thermally-induced stresses. For example, bond coats deposited by air plasma spraying (APS) typically have a surface roughness of about 200 microinches (5 $\mu$m) to about 500 microinches (13 $\mu$m) Ra, which has been shown to significantly promote adhesion of a ceramic TBC, particularly plasma sprayed TBCs that rely on mechanical interlocking for adhesion. However, APS bond coats generally have an excessively rough surface to be compatible with EBPVD ceramic layers. On the other hand, bond coats suitable for EBPVD TBCs, such as diffusion aluminide bond coats and PVD MCrAlY overlay bond coats, do not provide adequate surface roughness for plasma sprayed TBCs.

As taught in U.S. Pat. No. 5,419,971 to Skelly et al., an alternative approach for promoting spallation resistance is to arrest the propagation of cracks along the TBC/bond coat interface by forming grooves in the surface of the bond coat or substrate. According to Skelly et al., grooves and other surface features are able to deflect the crack tip, causing it to pass through phase boundaries that impede the progress of the crack along the interface. Skelly et al. disclose various methods for forming the grooves, including the use of laser and electron beams, micromachining, abrasives, engraving and photoengraving, each of which removes material from the bond coat or substrate to form the grooves. While notable improvements in spallation resistance have been achieved with the teachings of Skelly et al., shortcomings exist, including the processing and equipment costs required for the additional step of selectively removing material to form the grooves, and limitations as to which surfaces of a component can be treated to create the grooves. In addition, this process is not performed until the part being treated is near completion, resulting in a considerable investment in the part that can be lost if a mistake occurs during the process. Accordingly, there remains a need for improved methods for producing more spall-resistant thermal barrier coatings.

BRIEF SUMMARY OF THE INVENTION

The present invention generally provides a method of forming a thermal barrier coating system on an article subjected to a hostile thermal environment, such as the hot gas path components of a gas turbine engine. The coating system is generally composed of a ceramic layer and preferably a bond coat that adheres the ceramic layer to the component surface. According to this invention, surface features such as grooves are cast directly into the surface of the component, yielding a nonplanar and interrupted interface between the component surface and the ceramic layer. Grooves formed in this manner preferably have widths and depths of at least about twelve micrometers (about 0.0005 inch) and not more than about twenty-five micrometers (about 0.001 inch). If the component is formed from a sufficiently environmentally-resistant material (e.g., $\beta$NiAl) to render a bond coat unnecessary, the ceramic layer can be deposited directly on the component surface. Alternatively, if the bond coat is present, the grooves in the component surface cause the bond coat to also have grooves that generally correspond to the grooves in the component surface. Bond coat materials compatible with this invention include diffusion aluminides and MCrAlY alloys, wherein M is nickel, cobalt and/or iron. Notably, the present invention enables the use of diffusion aluminide bond coats with plasma sprayed TBCs, providing a reduced weight and relatively low cost combination as compared to other TBC systems, such as plasma-sprayed MCrAlY bond coats in combination with TBCs deposited by physical vapor deposition.

Similar to the teachings of Skelly et al., the thermal barrier coating of this invention is more resistant to spalling due to the presence of the grooves in the substrate surface. However, this invention provides a number of processing and cost advantages over the teachings of Skelly et al. as a result of the manner in which the grooves are formed. As part of the casting level processing, the present invention has minimal cost and processing impact because the grooves are formed during casting, thereby avoiding a separate step for forming the grooves. Forming the grooves at the casting level also has the advantage of being a batch process, instead of the single piece level process required by Skelly et al. Forming the grooves at the casting level also avoids damage to the bond coat (if present) which can occur using the various material removal techniques required by Skelly et al. Any subsequent repair of a TBC system on a component processed in accordance with this invention has minimal impact, since the process by which the grooves were formed does not need to be repeated. Performance-wise, a notable advantage of the present invention is that grooves can be formed in surface regions of a component that is difficult or impossible with the removal techniques required by Skelly et al. Accordingly, the overall spallation resistance of a TBC on a component with a complex geometry can exceed that possible with the teachings of Skelly et al.

Other objects and advantages of this invention will be better appreciated from the following detailed description.

DETAILED DESCRIPTION OF THE INVENTION

The present invention is generally directed to cast components that operate within environments characterized by relatively high temperatures, and particularly components that are subjected to a combination of thermal, mechanical and dynamic stresses. Examples are the hot gas path components of gas turbine engines, including high and low pressure blades, vanes and shrouds and combustor components. While the advantages of this invention will be illustrated and described with reference to components of gas turbine engines, the teachings of this invention are generally applicable to any cast component on which a thermal barrier coating would be useful to insulate the component from a hostile thermal environment.

Figure 1:
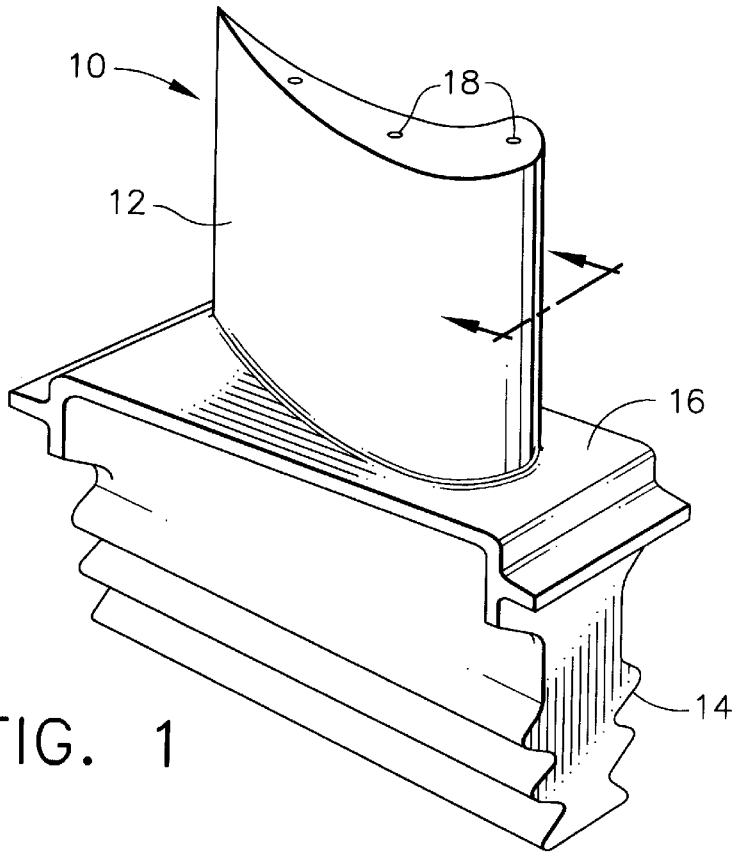
FIG. 1 is a perspective view of a high pressure turbine blade.

A high pressure turbine blade 10 is shown in FIG. 1 for the purpose of illustrating the invention. As is conventional, the blade 10 may be formed of an iron, nickel or cobalt-base superalloy. The blade 10 includes an airfoil section 12 and platform 16 against which hot combustion gases are directed during operation of the gas turbine engine, and whose surfaces are therefore subjected to severe attack by oxidation, corrosion and erosion. The airfoil 12 is anchored to a turbine disk (not shown) with a dovetail 14 formed on a root section of the blade 10. Cooling holes 18 are present in the airfoil 12 through which bleed air is forced to transfer heat from the blade 10 and film cool the surrounding surfaces of the airfoil 12.

Figure 2:
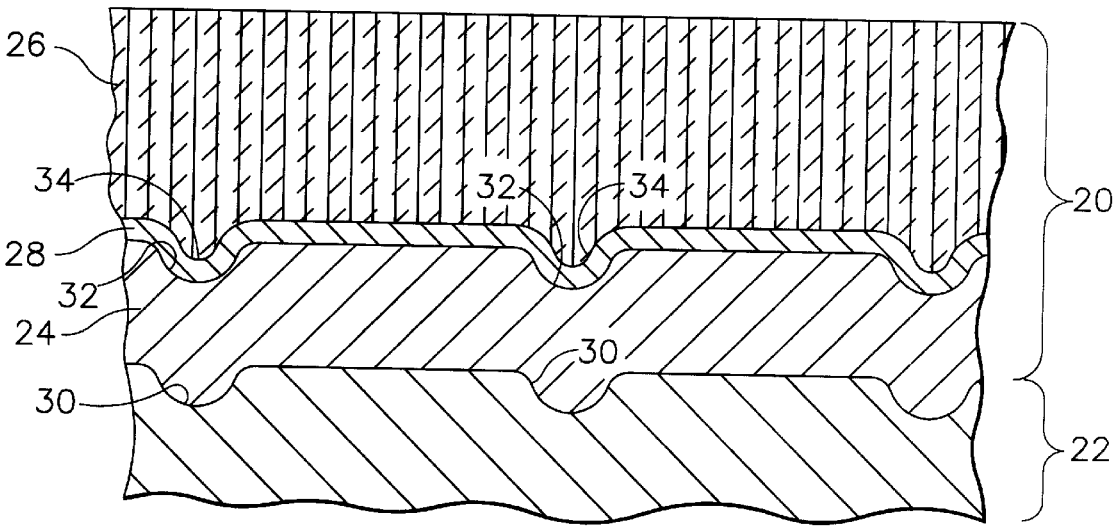
FIG. 2 represents a cross-sectional view of the blade of FIG. 1 and shows a thermal barrier coating system in accordance with this invention.

Represented in FIG. 2 is a thermal barrier coating system 20 in accordance with this invention. As shown, the coating system 20 includes a thermally-insulating ceramic layer 26 (the TBC) on a bond coat 24 that overlies a substrate 22, the latter of which is typically the base material of the blade 10. As is typical with thermal barrier coating systems for components of gas turbine engines, the bond coat 24 is an aluminum-rich material, such as a diffusion aluminide or an MCrAlY alloy, the latter of which is deposited by PVD. The ceramic layer 26 can also be deposited by plasma spraying or, as represented in FIG. 2, PVD and particularly EBPVD to yield a columnar grain structure. A preferred material for the ceramic layer 26 is an yttria-stabilized zirconia (YSZ), though other ceramic materials could be used, such as yttria, nonstabilized zirconia, or zirconia stabilized by magnesia, ceria, scandia or other oxides. The ceramic layer 26 is deposited to a thickness that is sufficient to provide the required thermal protection for the underlying substrate 22 and blade 10, generally on the order of about 75 to about 300 micrometers. An aluminum oxide (alumina) scale 28 is shown as having been thermally grown on the bond coat 24 at elevated processing temperatures, such as during the deposition of the ceramic layer 26. The alumina scale 28 serves to chemically anchor the ceramic layer 26 to the bond coat 24 and substrate 22 to yield a more spall-resistant coating system 20.

According to this invention, the thermal barrier coating system 20 is more resistant to spalling and delamination as a result of surface features, depicted in FIG. 2 as grooves 30, formed directly in the surface of the substrate 22. In contrast to the prior art, which has taught the inclusion of grooves by removing material from a bond coat or substrate, the grooves 30 of this invention are formed at the casting level. Specifically, the wax mold used to create a wax pattern for investment casting the blade 10 is modified to incorporate ribs or other suitable features that will produce the grooves 30. In this manner, the grooves 30 can be formed almost anywhere on the airfoil 12 and platform 16. After casting, the blade 10 can undergo standard manufacturing operations, such as laser drilling of the cooling holes 18, machining of critical dimensional surfaces, and the application of the bond coat 24 and ceramic layer 26. Notably, plasma spray deposition of the bond coat 24 is generally incompatible with this invention, as plasma spraying processes tend to obscure cast surface features such as the grooves 30.

As depicted in FIG. 2, the grooves 30 have semicircular cross-sections, though it is foreseeable that other cross-sectional configurations could be used, such as rectangular. In addition, surface features within the scope of this invention are not limited to the grooves 30 shown in FIG. 2, but can be cast in a variety of shapes and patterns, including dimples, starbursts, etc. Accordingly, the term "surface feature" as defined herein shall be understood to denote a depression of one form or another that is intentionally cast into the surface of the substrate 22. The cross-sections of the grooves 30 can also very considerably from that possible with the teachings of U.S. Pat. No. 5,419,971 to Skelly et al., discussed above.

To have a significant effect on the spallation resistance of the ceramic layer 26, it is believed that the spacing between adjacent grooves 30 should be about 0.005 to about 0.01 inch (about 127 to about 254 micrometers). To promote their desired effect, the grooves 30 can be produced in a cross-hatching pattern on the substrate 22. Furthermore, the grooves 30 are of sufficient dimensions to produce grooves 32 and 34 in the surfaces of the bond coat 24 and scale 28, respectively, yielding an interface with the ceramic layer 26 that can be described as being nonplanar and interrupted by the grooves 30. For this purpose, preferred dimensions for the grooves 30 are widths and depths of up to about 0.001 inch (about 25.4 micrometers, with a preferred range being about 0.0005 to about 0.001 inch (about 12.7 to about 25.4 micrometers). Likewise, the thickness of the bond coat 24 is preferably not more than about 0.005 inch (about 127 micrometers) in order to ensure that the groove 32 will be present in its surface. A preferred thickness range for the bond coat 24 is about 0.001 to about 0.005 inch (about 25.4 to about 127 micrometers). Notably, because the grooves 30 are formed in the surface of the substrate 22 instead of micromachined in the bond coat 24, the bond coat 24 of this invention has a uniform thickness that provides better environmental protection for the substrate 22. In addition, the bond coat 24 is not susceptible to contamination that can occur during micromachining.

An important aspect of this invention is that formation of the grooves 30 at the casting level is compatible with bond coats 24 and ceramic layers 26 deposited by any one of the conventional deposition techniques used for airfoil TBC systems. With each type of coating system, the grooves 30, as well as the grooves 32 and 34 formed in the bond coat 24 and scale 28 as a result of the grooves 30, crack propagation through the ceramic/bond coat interface is forced along a more difficult path, with the grooves 32 and 34 deflecting the crack tip and impeding its progress through interface. Notably, the present invention also enables the combination of a diffusion aluminide bond coat and a plasma sprayed TBC, the latter of which has traditionally required APS bond coats to provide enough surface roughness to mechanically interlock the ceramic layer to the bond coat.

While the invention has been described in terms of a preferred embodiment, it is apparent that other forms could be adopted by one skilled in the art. For example, surface features other than the grooves 30 shown in FIG. 2 could be used. In addition, the invention can be employed to anchor the ceramic layer 26 directly to the substrate 22, i.e., without the bond coat 24, as would be possible if the substrate 22 is formed of an oxidation resistant material such as βNiAl. Accordingly, the scope of the invention is to be limited only by the following claims.

What is claimed is:

1. A method comprising the steps of:

casting a hot gas path article of a gas turbine engine to have surface features in a surface thereof, each of the surface features having a width and depth of at least 0.0005 inch and not more than about 0.001 inch; and depositing a ceramic layer on the article, the ceramic layer overlying the surface features in the surface of the article, the surface features providing an interrupted interface with the ceramic layer that promotes adhesion of the ceramic layer to the article.

2. A method as recited in claim 1, further comprising the step of depositing a bond coat on the surface of the article, wherein the ceramic layer overlays the bond coat.

3. A method as recited in claim 2, wherein the bond coat is selected from the group consisting of diffusion aluminides and PVD MCrAlY alloys, wherein M is nickel, cobalt, iron, or a combination thereof.

4. A method as recited in claim 2, wherein the bond coat has surface features in a surface thereof corresponding to the surface features in the surface of the article.

5. A method as recited in claim 1, wherein the ceramic layer is deposited directly on the surface of the article.

6. A method as recited in claim 1, wherein the ceramic layer is deposited by a process selected from the group consisting of plasma spraying and physical vapor deposition.

7. A method as recited in claim 1, wherein the ceramic layer has a columnar grain structure.

8. A method as recited in claim 1, wherein the surface features are grooves.

9. A method as recited in claim 8, further comprising the step of depositing a bond coat on the surface of the article using a method chosen from the group consisting of diffusion and PVD, wherein the bond coat has grooves in a surface thereof corresponding to the grooves in the surface of the article.

10. A method as recited in claim 8, wherein adjacent pairs of the grooves are spaced apart about 0.005 to about 0.01 inch.

11. A method as recited in claim 8, wherein each of the grooves has a width and a depth of about 0.0005 to about 0.001 inch.

12. A method as recited in claim 8, wherein each of the grooves has a semicircular cross-section.

13. A method as recited in claim 8, wherein at least two sets of grooves are cast in the surface of the article, the at least two sets of grooves being nonparallel to each other.

14. A method as recited in claim 1, wherein the surface features are investment cast into the surface of the article.

15. A method as recited in claim 1, wherein the article is an airfoil component of a gas turbine engine.

16. A method comprising the steps of:

investment casting a hot gas path article of a gas turbine engine to have grooves in a surface thereof, each of the grooves having a width and a depth of at least 0.0005 inch and not more than 0.001 inch, adjacent pairs of the grooves being spaced apart about 0.005 to about 0.01 inch;

depositing a bond coat on the surface of the article, the bond coat being selected from the group consisting of diffusion aluminides and PVD MCrAlY alloys, wherein M is nickel, cobalt, iron, or a combination thereof, the bond coat having grooves in a surface thereof corresponding to the grooves in the surface of the article;

producing an oxide layer on the bond coat, the oxide layer having grooves in a surface thereof corresponding to the grooves in the surface of the bond coat; and depositing a ceramic layer on the oxide layer by a process selected from the group consisting of plasma spraying and physical vapor deposition, the ceramic layer overlying the grooves in the bond coat so that the grooves in the bond coat provide a grooved interface with the ceramic layer that promotes adhesion of the ceramic layer to the article.

17. A method as recited in claim 16, wherein the bond coat is a diffusion aluminide and the ceramic layer is deposited by plasma spraying.

18. A method as recited in claim 16, wherein each of the grooves has a semicircular cross-section.

19. A method as recited in claim 16, wherein at least two sets of grooves are investment cast in the surface of the article, the at least two sets of grooves being nonparallel to each other.

20. A method as recited in claim 16, wherein the article is an airfoil component of a gas turbine engine.

* * * * *